United States Patent [19]

Councell

[11] 4,288,674

[45] Sep. 8, 1981

[54] MICROWAVE ACTUATED STEAM GENERATOR

[76] Inventor: Graham D. Councell, 8242 Brookgreen Rd., Downey, Calif. 90240

[21] Appl. No.: 142,103

[22] Filed: Apr. 21, 1980

[51] Int. Cl.[3] ..... H05B 6/80

[52] U.S. Cl. ..... 219/10.55 A; 219/10.55 R; 219/333; 219/401

[58] Field of Search ..... 219/10.55 A, 10.55 R, 219/10.55 F, 10.55 M, 401, 333

[56] References Cited

U.S. PATENT DOCUMENTS

| | | | |
|---|---|---|---|
| 3,891,817 | 6/1975 | Brown | 219/10.55 R |
| 4,114,011 | 9/1978 | Stubbs | 219/10.55 R X |
| 4,114,012 | 9/1978 | Moen et al. | 219/10.55 A |
| 4,152,567 | 5/1979 | Mayfield | 219/10.55 A |
| 4,165,455 | 8/1979 | Mayfield | 219/10.55 A |

*Primary Examiner*—Arthur T. Grimley
*Attorney, Agent, or Firm*—William C. Babcock

[57] ABSTRACT

An apparatus and method of using the same in which microwave energy transforms water in the form of finely divided droplets having a large aggregate surface area into pressurized steam. The method of the present invention has a high thermal and electrical efficiency, as the microwave energy impinges directly on the water droplets, and there is no loss of heat by conduction or convection.

5 Claims, 1 Drawing Figure

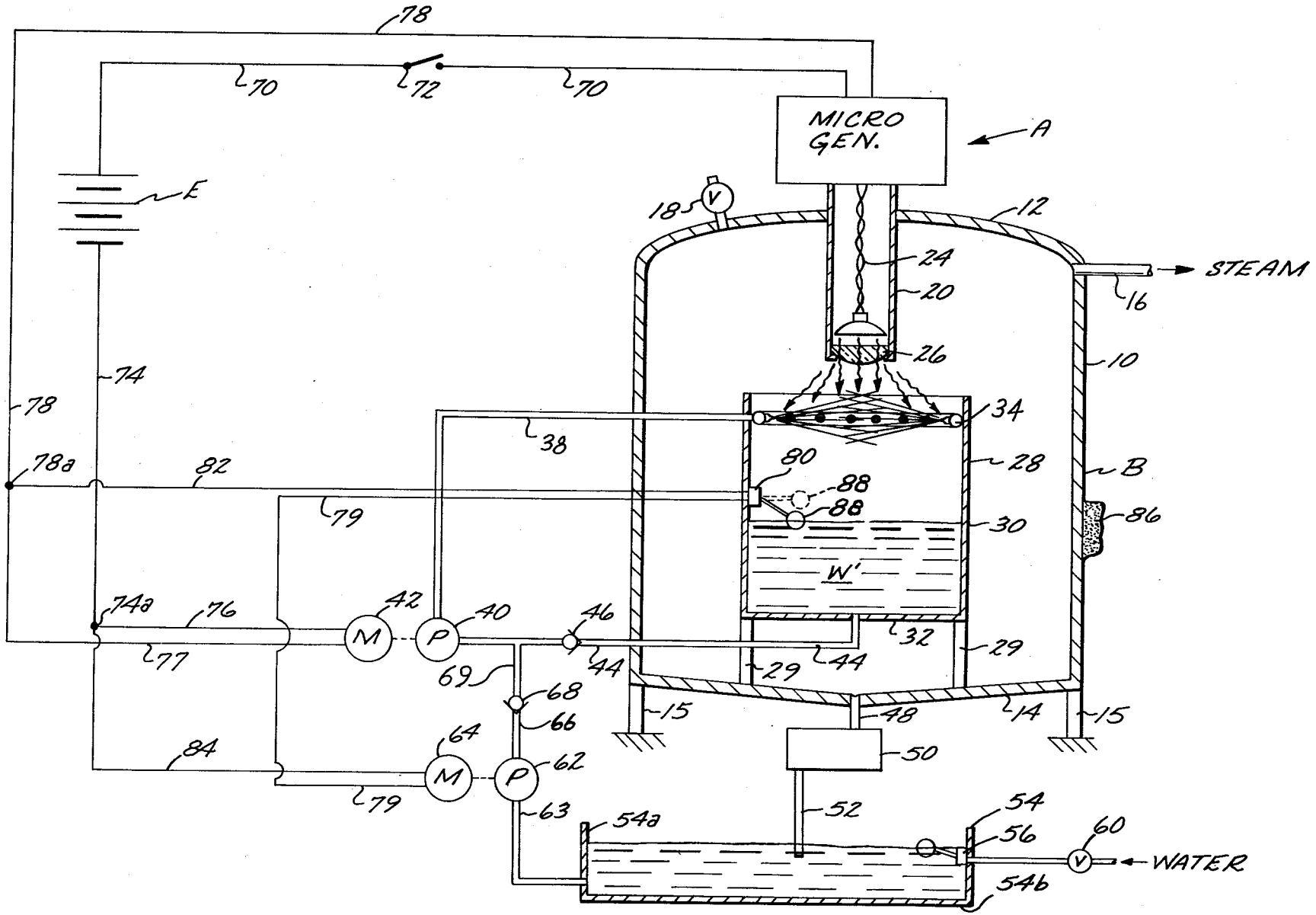
STEAM
WATER
MICRO GEN.
A
B
W'
E

MICROWAVE ACTUATED STEAM GENERATOR

BACKGROUND OF THE INVENTION

1. Field of the Invention

Microwave Actuated Steam Generator.

2 Description of the Prior Art

In the past, various types of equipment have been devised and used in which electric energy either by resistance elements or other heat generating means is used to heat water or transform the same to steam. Such prior art devices have the operational disadvantage that the water is transformed to steam while in a conduit or container, and as a result the electrical energy used not only heats the water but the container or conduit. This heating of the container or conduit in which the water is disposed results in substantial heat losses due to heat transfer through the material defining the container or conduit, as well as through radiation of heat from the container or conduit.

A major object of the present invention is to provide a device and method of using the same in which microwave energy is directed onto a spray or mist of finely divided droplets of water that have a large aggregate surface area and are disposed within a confined space. Due to the microwave energy impinging directly on the mist of droplets of water, which droplets in the aggregate have a large surface area, there is a high electrical efficiency in transforming the energy of the microwave into heat energy in which the droplets are volatilized to form pressurized steam that flows from the confined space for conventional uses such as heating or power purposes.

Another object of the invention is to supply an apparatus and method of using the same to transform water to pressurized steam by a simple, dependable, economical means and one that requires no burning of fossil fuels at the source of transformation, but instead uses electrical energy that may be generated at a remote location.

Another object of the invention is to supply an apparatus and method of using the same in which electrical energy is only utilized when water is being transformed to steam, and with such transformation being effected almost instantly after the apparatus of the present invention has been actuated.

These and other objects and advantages of the invention over the prior art will become apparent from the following description of a preferred form thereof, and from the drawings illustrating that form.

SUMMARY OF THE INVENTION

The invention includes a boiler having a steam outlet in the upper portion thereof, and a number of nozzles also being located in the upper portion of the boiler and preferably a range in the form of a circle. The nozzles are in communication with a tubular ring or other water conducting conduit. When pressurized water is supplied to the nozzles, the water discharges therefrom in the form of a spray, with the spray including tiny droplets of water that in the aggregate have a very high surface area.

A microwave emitter is located in the upper interior of the boiler and is so arranged that microwave energy is directed downwardly to impinge directly on the droplets as they discharge and transform the major portions thereof into steam. The portion of the droplets not converted to steam drop downwardly by gravity into a container located within the boiler and situated below the nozzle. The droplets of water falling into the container coalesce to define a body of water therein.

Water is continuously withdrawn from the container by a first motor driven recirculation pump, and is directed back to the nozzles to be again converted into spray in the form of a number of minute droplets. A second motor driven water make-up pump is operatively associated with a source of domestic water. An electric circuit that includes a liquid level sensor at all times maintains the water in the container at a predetermined level by the water make-up pump motor being energized as required. Condensate in the bottom of the boiler periodically discharges therefrom through a steam trap to be added to the makeup water.

BRIEF DESCRIPTION OF THE DRAWINGS

FIG. 1 is a diagrammatic view of a preferred form of the invention.

DESCRIPTION OF THE PREFERRED EMBODIMENT

The microwave steam generator assembly A as may best be seen in the drawing includes a boiler B that is formed from steel or the like, and includes a cylindrical side wall 10, an upper end 12, and a bottom 14, with the boiler being illustrated as supported on legs 15. The boiler B has a steam outlet 16 extending from the upper interior portion thereof, and the end 12 of the boiler also having a pressure relief valve 18 mounted thereon, and in communication with the interior of the boiler.

A tube 20 extends downwardly through the top 12 and on the upper end is in communication with a microwave generator assembly 22, which through suitable conductors 24 energizes a microwave emitter 26 located at the lower end portion of the tube 20.

A container for water is located within the boiler B and located directly under the microwave emitter 26 as may be seen in the drawing. The container 28 includes a cylindrical side wall 30 and a bottom 32, with the container preferably being supported in an elevated position above the bottom 14 of the boiler by legs 29.

The invention A as illustrated in the drawing has a hollow tubular ring 34 supported in the upper portion of the container 28, and this ring having a number of circumferentially spaced nozzles projecting inwardly towards one another. The nozzles are of a type that transforms water discharging therethrough into a spray that includes a number of very finely divided droplets of water, which droplets of water in the aggregate have a high surface area.

Water is supplied to the tubular ring 34 by a conduit 38 that extends to the discharge side of a water recirculating pump 40. The water recirculating pump 40 as may be seen in the drawing is driven by a first electric motor 42. A conduit 44 extends from the suction side of the water recirculating pump 40 through the side wall 10 into the bottom 32 of the container 28. The conduit 44 has a first check valve 46 therein that permits flow of water from the container to the suction side of the water recirculating pump 40.

The bottom 14 of the boiler B tapers downwardly to an opening in the center thereof from which a conduit 48 extends downwardly to a steam trap 50, which trap periodically discharges steam condensate therefrom through a conduit 52 to a water reservoir 54. The water reservoir 54 has a side wall **54*a* and bottom 54*b*. A float actuated valve 56 is mounted on the side wall 54*a* as may be seen in the drawing, with the float valve being connected by a conduit 58 to a source of domestic water not shown. The conduit 58 has a manually operated shut-off valve 60 therein. A second pump 62 is provided that supplies feed water as required to the invention, with the second pump being driven by a second electric motor 64. The suction side of the second pump 62 is connected by a conduit 63 to the interior of the reservoir 54 as shown in the drawing. The discharge side of the second pump 62 has a conduit 66 extending therefrom to a second check valve 68, with the second check valve being connected by a conduit 69 to the conduit 44. The check valve 68 permits water to discharge from the pump 62 to the conduit 44**.

The invention A is energized from a source of electric power E that has a conductor 70 extending from one terminal thereof to the microwave generator assembly 26, with the conductor 70 having a switch 72 interposed therein which when opened stops the operation of the invention A. A conductor 74 extends from the second terminal of the source of electric power E to a junction point 74*a*, which junction point has a conductor 76 extending to the first motor 42. A conductor 77 extends from the second terminal of the motor 42 to the junction point 78*a*. In the conductor 78 that is connected to the microwave generator assembly 26. An electrical conductor 78 extends from one terminal of the second motor 64 to an electrically actuated liquid level height sensor 80 located within the container 28, and the other terminal of the sensor being connected by an electrical conductor 82 to the junction point 78*a*. The second terminal of the second electric motor 64 is connected by an electrical conductor 84.

The use and operation of the invention is quite simple. When the switch 72 is placed in the closed position an electric circuit is completed from the source of electrical energy E through conductor 70 to the microwave generator 22, and from the generator through conductor 78 junction point 78*a*, conductor 77 to motor 42 and through a conductor 76 connected to the second terminal of the motor to junction point 74*a* and then through conductor 74 to the second terminal of the source of electrical energy E. With the circuit so completed the motor 42 drives the first pump 40 to discharge water to the liquid level elevation sensor 80 has one terminal connected to a conductor 82 that extends to junction point 78*a*, and the other terminal connected to a conductor 79 that extends to a first terminal of the second motor 64, with the second terminal of the motor connected to a conductor 84 that extends to junction point 74*a*, and a conductor 74 extending from junction point 74*a* to a second terminal of the source of electrical energy E. At the initiation of the operation of the invention A the sensor 80 will sense that there is not water in the container 30 and will complete the circuit to the sensor above described. The motor 64 will be energized, and drive the pump 62 to draw water W from the reservoir 54 and supply the same to the suction side of the first pump 40. The pump 40 will discharge water under pressure to the nozzle 36 where the water is formed into sprays that are directed to one another, with the spray S of water being composed of extremely finely divided droplets that in the aggregate have a large surface area. The droplets of water in the sprays S are exposed to the microwave M discharged from the emitter 26, and the microwave upon contacting the droplets of water vaporize the same into steam which escapes from the boiler B through the outlet 16. Droplets of water in the sprays S that are not so vaporized drop downwardly into the container 30 to coalesce into a body of water W′ that is constantly drawn out of the container by the first pump 40 to again be recirculated through the nozzles 36. The sensor 80 is preferably an electric switch that is in the open position when the float 88 is below the first position shown in phantom line. Upon the float 80*a* rising to the position shown in phantom line, the sensor 80 assumes an open position to break the circuit to the second motor 64, and water to define the spray 36 being supplied by the pump 40 that is recirculating water W′ already in the lower portion of the container 30 to the nozzle 36 to define the spray S. When the float 88 moves downwardly a predetermined distance below the position shown in phantom line in the drawing, the sensor assumes the closed position and completes an electric circuit to the second pump 62, which pump discharges water W from the reservoir 54 to the conduit 44 connected to the suction side of the first pump 40. The first pump 40 now supplies such water to the nozzles 63, and a portion of this water being transformed by the microwave M that impinge on the spray S to steam and the balance dropping downwardly by gravity into the container W to coalesce to form water W′ which is again recirculated through the nozzles 36 to be transformed into steam. The microwave M that do not impinge on the droplets in the spray S do impinge on the water W′ in the reservoir and tend to heat the same, and as a result complete utilization of microwaves M is achieved in heating the water to transform the same to steam.

The microwave emitter 26 is shown in the lower portion of the tube 20, but such positioning is not essential to the successful operation of the invention and it may be located at any desired position within the boiler B so long as the microwave M impinge on the spray S. Should it be desired the emitter 26 may rotate within the confines of the boiler M to provide microwaves M that are not only moving downwardly but have rotational movement relative to the spray S. To minimize heat loss from the steam generated within the boiler M due to the microwaves impinging on the spray S, it is preferable that the boiler be enveloped in a heat insulating material 86. Steam that condenses within the boiler B drops downwardly to the bottom 14 and discharges into the steam trap 40 where it is periodically discharged automatically from the trap as condensate through the conduit 52 to the reservoir 54 to tend to preheat the water W therein.

The use and operation of the invention has been described previously in detail and need not be repeated.

What is claimed is:

1. In a steam generator having a boiler in the form of a hollow pressure vessel that has a top and bottom; a steam outlet in communication with the upper interior of said boiler; a pressure relief valve in communication with the upper interior of said boiler; a condensate drain in said bottom, a microwave generator; and a microwave emitter energized by said microwave generator, said emitter located in the upper interior of said boiler; and a source of water; and a source of electric power; the improvement for generating steam in said boiler, said improvement including:

a. a plurality of circumferentially spaced nozzles arranged as a horizontal ring in the upper interior portion of said boiler below said microwave emitter, said nozzles when supplied water under pressure transforming the latter to a plurality of sprays of fine droplets thereof, said sprays being directed horizontally towards one another to define a circular spray area on which microwaves from said emitter impinge to transform a first portion thereof to steam and a second portion of said droplets moving downwardly in said boiler by gravity;

b. a first pump and a first electric motor that drives the same, said pump having a first discharge outlet and a first suction inlet;

c. a container in said boiler below said nozzles that receives said second portion of said droplets that coalesce therein to a body of water in said container, and said microwaves that do not vaporize droplets impinging on said body of water to heat the same;

d. a first electric circuit extending from said source of electric power to said microwave generator and said first motor to concurrently energize said generator and motor;

e. a first conduit means that conducts water from said first discharge outlet to said nozzles to be transformed to said sprays;

f. a second conduit means that conducts water from said container to said first suction inlet of said first pump to be recirculated to said nozzles to again be formed into said sprays;

g. a second pump and electric motor that drives the same, said second pump including a second discharge outlet and second suction inlet;

h. water level elevation sensing means in said container that becomes conductive only when said water level falls below a predetermined elevation;

i. third conduit means that connect said second suction inlet to said source of water;

j. fourth conduit means that connect said second discharge outlet to said second conduit;

k. a second electric circuit connected to said source of electric power and including said water level sensing means and said second motor, with said second pump being driven to supply make-up water to said first pump only when said water level in said container falls below said predetermined elevation; and l. a steam trap in communication with said drain for discharging steam condensate to the exterior of said boiler.

2. A steam generator as defined in claim 1 which in addition includes:

m. a tubular ring supported at a fixed position in said boiler, said ring having the interior thereof connected to said first conduit, and said ring supporting said nozzles therefrom, with said nozzles in communication with the interior of said ring.

3. A steam generator as defined in claim 1 which in addition includes:

m. first and second check valve means in said second and fourth conduits for preventing water discharges from said second discharge outlet flowing to said containers and water discharged from said containers flowing to said second discharge outlet of said second pump.

4. A steam generator as defined in claim 1 which in addition includes:

m. a fifth conduit connected to said steam trap and in communication with said second suction inlet through which condensate discharged from said steam trap flow to be recirculated into said boiler.

5. A method of transforming water to steam that includes the steps of:

a. defining a confined space that has a steam outlet;

b. discharging water under pressure into an upper portion of said confined space to provide a spray area defined by a plurality of droplets that in the aggregate have a substantial surface area;

c. subjecting said spray area in said confined space to microwaves that impenge directly thereon and transform a substantial portion thereof to steam;

d. collecting said droplets in said confined areas not converted to steam to define a body of water in said confined space;

e. heating said body of water with said microwaves; and f. recirculating said heated body of water into said confined space to define said spray area.

* * * * *